US007080500B2

(12) United States Patent
Akiyama et al.

(10) Patent No.: US 7,080,500 B2
(45) Date of Patent: Jul. 25, 2006

(54) RUBBER REINFORCING CORD AND RUBBER PRODUCT EMPLOYING THE SAME

(75) Inventors: Mitsuhara Akiyama, Tokyo (JP); Keisuke Kajihara, Tokyo (JP)

(73) Assignee: Nippon Sheet Glass Co., Ltd., Tokyo (JP)

( * ) Notice: Subject to any disclaimer, the term of this patent is extended or adjusted under 35 U.S.C. 154(b) by 0 days.

(21) Appl. No.: 10/998,919

(22) Filed: Nov. 30, 2004

(65) Prior Publication Data

US 2005/0091960 A1 May 5, 2005

Related U.S. Application Data

(63) Continuation of application No. PCT/JP03/07179, filed on Jun. 6, 2003.

(30) Foreign Application Priority Data

Jun. 10, 2002 (JP) ..... 2002-168521

(51) Int. Cl.
*D02G 3/48* (2006.01)

(52) U.S. Cl. ..... 57/212; 57/232

(58) Field of Classification Search ..... 57/210, 57/229, 232, 237
See application file for complete search history.

(56) References Cited

U.S. PATENT DOCUMENTS 3,029,590 A * 4/1962 Caroselli et al. ..... 57/237
5,130,193 A * 7/1992 Ikeda ..... 428/365

FOREIGN PATENT DOCUMENTS

| | | |
|---|---|---|
| JP | 55-84432 | 6/1980 |
| JP | 59-15780 | 5/1984 |
| JP | 61-71204 | 4/1986 |
| JP | 0 329 593 | 8/1989 |
| JP | 2-145829 | 6/1990 |
| JP | 9-76707 | 3/1997 |
| JP | 10-297210 | 11/1998 |
| JP | 2003-41447 | 2/2003 |

* cited by examiner

*Primary Examiner*—Shaun R Hurley
(74) *Attorney, Agent, or Firm*—Manabu Kanesaka

(57) ABSTRACT

A rubber reinforcing cord having high flexural fatigue resistance and high dimensional stability is provided and a rubber product such as a rubber belt employing the cord is provided. The cord includes a fibrous core and a plurality of subsidiary strands which are disposed around the fibrous core and each of which is twisted by a primary twist, in which the fibrous core and the subsidiary strands are twisted together by a final twist. The direction of the primary twist of the subsidiary strands and the direction of the final twist are the same and the fibrous core is twisted by a primary twist in a direction opposite to the direction of the primary twist of the subsidiary strands. A rubber product is reinforced with the rubber reinforcing cord.

14 Claims, 1 Drawing Sheet

RUBBER REINFORCING CORD AND RUBBER PRODUCT EMPLOYING THE SAME

CROSS REFERENCE TO RELATED APPLICATION

This is a continuation application of PCT/JP03/07179 filed on Jun. 6, 2003.

FIELD OF THE INVENTION

The present invention relates to a rubber reinforcing cord to be embedded into rubber products such as rubber belts and rubber tires and also to a rubber product reinforced by the rubber reinforcing cord.

BACKGROUND OF THE INVENTION

Since rubber products such as rubber belts and rubber tires are subjected to high tensile force when used, cords composed of twisted yarns made of glass fiber or aramid fiber are used as reinforcing member to be embedded into such rubber products. Such a cord is made of glass fiber or aramid fiber in the following manner. That is, a primary twist is imparted to filaments of the fiber such that the filaments are twisted into twisted yarns and a final twist is imparted to the plural twisted yarns such that the twisted yarns are further twisted together into a cord. The characteristics of the cord are controlled by changing the condition of the primary twist and the final twist and/or the combination therebetween. For example, by increasing the twisting rate of the primary twist and the final twist, the flexural fatigue resistance of the cord is improved. This is because of the following reason. That is, when the cord made of twisted yarns is bent, the bent portion is subjected to tensile force at the outside thereof and is subjected to bucking force at the inside thereof. Since the higher twisting rate facilitates the expansion and contraction of the twisted yarns, the aforementioned tensile force and bucking force are dispersed and thus received by the entire cord. On the other hand, by decreasing the twisting rate in the primary twist and the final twist, the dimensional stability of the cord is increased. The reason can be easily understood from the fact that the elongation of a reinforcing member with fiber which is not twisted at all is equal to the elongation of the fiber itself.

A cord, in which the direction of the final twist is the same as the direction of the primary twist, has excellent flexural fatigue resistance. This is because of the following reason. That is, as the cord made of the twisted yarns is twisted only in one direction wholly, the twisted yarns made by the primary twist are further twisted in the same direction by the final twist, thereby exhibiting the similar effect of the aforementioned increase in the twisting rate. As an example of such reinforcing members, Japanese Utility Model Publication No. S59-15780 discloses a reinforcing member made of glass fiber manufactured by imparting a primary twist to its filaments such that the filaments are twisted into twisted yarns and by imparting a final twist to the twisted yarns such that the twisted yarns are twisted in the same direction as the primary twist.

A cord, in which the direction of the final twist is opposite to the direction of the primary twist, has excellent dimensional stability. This is because of the following reason. That is, twisted yarns made by the primary twist are twisted in the opposite direction by the final twist, thereby exhibiting the similar effect of the aforementioned decrease in the twisting rate of the primary twist.

In view of the aforementioned concerns between the primary twist and the final twist, the improvement in the flexural fatigue resistance and the retention of the high dimensional stability of the cord are in relation contradicting each other. It seems quite difficult to achieve the both of them concurrently.

DISCLOSURE OF THE INVENTION

It is an object of the present invention to provide a rubber reinforcing cord having high flexural fatigue resistance and high dimensional stability and also to provide a rubber product such as a rubber belt employing the rubber reinforcing cord.

A rubber reinforcing cord of the present invention includes a fibrous core and a plurality of subsidiary strands which are disposed around the fibrous core and each of which is twisted by a primary twist, in which the fibrous core and the subsidiary strands are twisted together by a final twist. In the cord, the direction of the primary twist of the subsidiary strands and the direction of the final twist are the same, and the fibrous core is twisted by a primary twist in a direction opposite to the direction of the primary twist of the subsidiary strands or not twisted primarily.

As mentioned above, when the rubber reinforcing cord is bent, the bent portion is subjected to tensile force at the outside thereof and is subjected to bucking force at the inside thereof. Since the twisted yarns, of which flexural fatigue resistance is high and of which twisting rate is high, are disposed along the outer periphery in the rubber reinforcing cord of the present invention, the flexural fatigue resistance of the rubber reinforcing cord is improved.

When the cord is bent, the tensile force and the bucking force received at the center of the rubber reinforcing cord are smaller as compared to those at the outer periphery. In the rubber reinforcing cord of the present invention, therefore, the fibrous core which is twisted in the direction opposite to the direction of the primary twist of the subsidiary strands or not twisted primarily is disposed at the center thereof in order to retain high dimensional stability of the rubber reinforcing cord. The rubber reinforcing cord having the fibrous core which is twisted in the direction opposite to the direction of the primary twist of the subsidiary strands can exhibit the similar effect of the decrease in the twisting rate of the fibrous core because the primary twist of the fibrous core is slightly unwound through the final twist so that the fibrous core becomes closer to the non-twisted state or the little-twisted state, thereby retaining high dimensional stability of the rubber reinforcing cord.

In the rubber reinforcing cord of the present invention, when the fibrous core is not subjected to the primary twist, i.e. not twisted primarily, only the final twist is imparted to the fibrous core. Therefore, the twisting rate is small, thereby retaining high dimensional stability of the rubber reinforcing cord. The rubber reinforcing cord of the present invention is embedded into a rubber product such as a rubber tire or a rubber belt so as to significantly improve the tensile strength and the durability of the rubber product.

DESCRIPTION OF THE PREFERRED EMBODIMENTS

Figure 1:
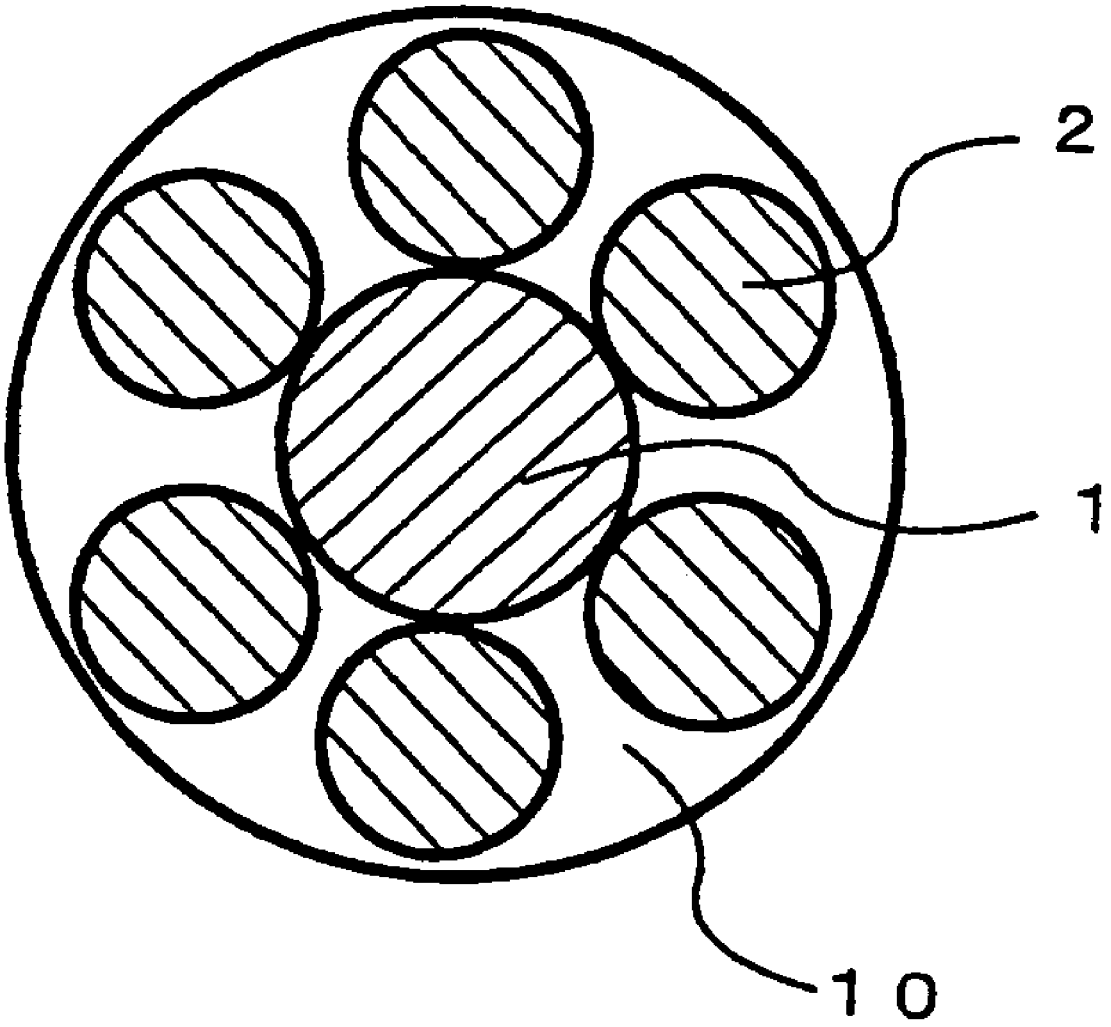
FIG. 1 is an illustration schematically showing a section of a rubber reinforcing cord manufactured in Example 1.

Hereinafter, a preferred embodiment of the present invention will be described in detail.

A rubber reinforcing cord 10 of the present invention comprises a fibrous core 1 disposed at the center and subsidiary strands 2 disposed around the fibrous core 1. The fibrous core 1 and the subsidiary strands 2 are twisted together by a final twist in the same direction as the primary twist of the subsidiary strands 2.

The fibrous core may be twisted in a direction opposite to the direction of the primary twist of the subsidiary strands or not twisted primarily. Preferably, the fibrous core is twisted in the opposite direction of the primary twist of the subsidiary strands. As the twisting rate of the primary twist of the fibrous core is set about equal to the twisting rate of the final twist, the fibrous core becomes closer to the non-twisted state or the little-twisted state, thereby exhibiting the similar effect of the decrease in the twisting rate. It is preferable, but not limited to, that the twisting rate of the primary twist of the fibrous core is from 40 to 100 turns/100 cm. It is preferable, but not limited to, that the twisting rate of the subsidiary strands is from 40 to 150 turns/100 cm. It is preferable, but not limited to, that the twisting rate of the final twist is from 40 to 150 turns/100 cm.

The fibrous core may be a single fiber or a bundle of single fibers. In case that the fibrous core is a bundle of single fibers, each of the single fibers must be twisted in the opposite direction of the primary twist of the subsidiary strands or not twisted primarily.

The fibrous core (including the aforementioned single fibers) is preferably, but not limited to, glass fiber, polyparaphenylene benzobisoxazole (PBO) fiber, carbon fiber, or aramid fiber. These fibers are excellent in tensile strength as compared to other organic fibers which are available as reinforcing members. Glass fiber, especially high strength glass fiber, is suitable as the fibrous core of the rubber reinforcing cord to be used in, for example, a timing belt of an internal combustion engine, because of its high heat resistance.

When the fibrous core is glass fiber, the average diameter of its filaments (the minimum unit of glass fiber) is preferably 5–11 μm, but not limited thereto. The number of filaments composing the fibrous core is preferably in a range from 200 to 5000, but not limited thereto. The fibrous core may be composed of one strand or 2–10 strands each of which is a bundle of 20–2500 filaments.

The subsidiary strands are disposed around the fibrous core. As for the arrangement specifications such as the positional relation between the subsidiary strands and the fibrous core and the number of the subsidiary strands, there is no particular limitation, except that the fibrous core exists closer to the center and the subsidiary strands exist closer to the outer periphery as seen in the section of the rubber restraining cord. However, it is preferable that the subsidiary strands are arranged about the fibrous core along a circle coaxially with the fibrous core at equal intervals. The rubber reinforcing cord having such an arrangement exhibits the same flexural fatigue resistance and the same dimensional stability against bending in any direction.

The subsidiary strands are twisted yarns each of which is made by imparting a primary twist to a bundle of filaments of glass fiber, PBO fiber, carbon fiber, or aramid fiber. The direction of the final twist may be the same as the direction of the primary twist, thereby exhibiting the similar effect of the increase in the twisting rate of the subsidiary strands. By disposing the subsidiary strands around the fibrous core, the flexural fatigue resistance of the rubber reinforcing cord can be improved dramatically.

Since the subsidiary strands are disposed around the fibrous core and must bear the tensile force and the bucking force, the diameter of each subsidiary strand is preferably smaller than that of the fibrous core. The cross sectional area of the fibrous core (including spaces between filaments. In case of the fibrous core being composed of a plurality of strands, the sum of the cross sectional areas of the strands.) is from 5% to 95%, preferably from 30% to 70% relative to the cross sectional area of the entire cord. When the cross sectional area of the fibrous core is in the aforementioned range, the improvement of the flexural fatigue resistance and the retention of the dimensional stability are both achieved in a balanced manner.

To increase the adhesiveness relative to matrix rubber of a rubber product, at least either the fibrous core or the subsidiary strands is usually applied with adhesive agent. Such adhesive agent may contain a component for enhancing conformability relative to the matrix rubber. The adhesive agent may be a mixed solution containing Resorcinol Formaldehyde Latex (RFL), epoxy resin and/or isocyanate compound. The adhesive agent also exhibits a function of preventing the fibrous core or the subsidiary strands from fraying.

In case of either the fibrous core or the subsidiary strands being made of glass fiber, publicly known binder containing silane coupling agent and the like may be applied to the filaments before applying the aforementioned adhesive agent in order to prevent the filaments from fraying or prevent the filaments from grazing each other and thus from having scratches.

The fibrous core and the subsidiary strands are twisted at desired twisting rates by a twisting apparatus. The final twist is imparted to the fibrous core and the subsidiary strands with arranging the subsidiary strands around the fibrous core by an apparatus. This apparatus may be a known apparatus such as a ring twisting frame, a flyer twisting frame or a spinning machine.

The fibrous core and the subsidiary strands twisted together can be used as a rubber reinforcing cord directly, or may be surface-treated with the aforementioned adhesive agent and a secondary treating agent having compatibility relative to the matrix rubber in order to further improve the adhesiveness relative to the matrix rubber of a rubber product. The secondary treating agent may contain cross-linking agent or may be CSM (Chlorosulfonated Polyethylene).

EXAMPLES AND COMPARATIVE EXAMPLES

Hereinafter, the present invention will be described in further detail with reference to Examples and Comparative Examples.

Example 1

A bundle of 600 filaments of E glass composition of which average diameter is 9 μm was prepared and applied with binder. The bundle was impregnated with RFL solution to have deposit efficiency of 20% by weight on solid basis. After that, the primary twist was imparted to the bundle such that the bundle was twisted at a twisting rate of 80 turns/100 cm in the S-twist direction by a twisting machine, thereby forming a fibrous core. Bundles of 600 filaments of the same composition were impregnated to have deposit efficiency of 20% by weight on solid basis. The primary twist was imparted to the bundles such that the bundles were twisted at a twisting rate of 80 turns/100 cm in the Z-twist direction by the twisting machine, thereby forming subsidiary strands.

The one fibrous core and the six subsidiary strands were grouped together and were subjected to the final twist such that they were twisted at a twisting rate 80 turns/100 cm in the Z-twist direction by the twisting machine, after that, were applied with secondary treating agent to have deposit efficiency of 4% by weight on solid basis, and heated and dried, thereby obtaining a rubber reinforcing cord.

As for the rubber reinforcing cord, the tensile strength (initial strength) and the elongation at break were measured. The cord was set to a bending tester. Before and after the cord was bent 10000 times, its tensile strength was measured. The constitution of the rubber reinforcing cord and the results of measurement of its characteristics are shown in Table 1.

Example 2 and Comparative Examples 1–3

Rubber reinforcing cords were prepared in the same manner as Example 1 except the respective constitutions as shown in Table 1. The characteristics of these rubber reinforcing cords were measured. PBO fiber used in Example 2 and Comparative Example 2 was a product without being twisted having 160 tex available from Toyobo Co., Ltd. The constitutions of the rubber reinforcing cords and the results of measurement of their characteristics are shown in Table 1.

TABLE 1

| Item | Fibrous core Kind of fiber No. of strands Primary twist | Subsidiary strand Kind of fiber No. of strands Primary twist | Final twist | Yarn count g/1000 m | Initial tensile strength N/cord | Elongation at brake % | Retention of strength after bending % |
|---|---|---|---|---|---|---|---|
| Example 1 | E glass One S-twist | E glass Six Z-twist | Z-twist | 953 | 635 | 3.12 | 75 |
| Example 2 | PBO fiber One S-twist | E glass Six Z-twist | Z-twist | 972 | 616 | 2.07 | 78 |
| Comparative Example 1 | E glass One Z-twist | E glass Six Z-twist | S-twist | 939 | 626 | 3.1 | 51 |
| Comparative Example 2 | PBO fiber One Z-twist | E glass Six Z-twist | S-twist | 924 | 752 | 2.31 | 65 |
| Comparative Example 3 | E glass One S-twist | E glass Six S-twist | S-twist | 944 | 622 | 3.71 | 74 |

From the comparison between the aforementioned Examples and Comparative Examples, we can find the followings.

The comparison between Example 1 and Comparative Example 1 verifies that the rubber reinforcing cord, in which the direction of the primary twist of the fibrous core is opposite to the direction of the primary twist of the subsidiary strands and opposite to the direction of the final twist, has improved flexural fatigue resistance with retaining high dimensional stability.

The comparison between Example 2 and Comparative Example 2 verifies that the rubber reinforcing cord made by using PBO fiber has further improved dimensional stability in addition to the effects of the aforementioned Example 1.

The comparison between Example 1 and Comparative Example 3 verifies that the cord in which all of the direction of the primary twist of the fibrous core, the direction of the primary twist of the subsidiary strands, and the direction of the final twist are the same, has improved flexural fatigue resistance, but significantly reduced dimensional stability.

INDUSTRIAL APPLICABILITY

A rubber reinforcing cord of the present invention has excellent flexural fatigue resistance and can retain high dimensional stability of a rubber product employing the cord. Therefore, a rubber product reinforced with this cord can exhibit high dimensional stability and tensile strength for a long period of time even when it is a product, such as a timing belt for an internal combustion engine, which is subjected to quite severe condition when used.

What is claimed is:

1. A rubber reinforcing cord including a fibrous core and a plurality of subsidiary strands disposed around the fibrous core, each of said plurality of subsidiary strands being twisted by a subsidiary strand primary twist, and the fibrous core and the subsidiary strands being twisted together by a final twist, wherein the direction of the subsidiary strand primary twist and the direction of the final twist are the same, and said fibrous core is twisted by a fibrous core primary twist in a direction opposite to the direction of the subsidiary strand primary twist, or is not twisted primarily wherein the diameter of each subsidiary strand is smaller than the diameter of the fibrous core.

2. A rubber reinforcing cord as claimed in claim 1, wherein said fibrous core and said subsidiary strands are made from at least one fiber selected from the group consisting of glass fiber, polyparaphenylene benzobisoxazole fiber, carbon fiber, and aramid fiber.

3. A rubber reinforcing cord as claimed in claim 1, wherein said fibrous core and said subsidiary strands are made from glass fiber.

4. A rubber reinforcing cord as claimed in claim 3, wherein the average diameter of filaments of the glass fiber of the fibrous core is 5–11 μm.

5. A rubber reinforcing cord as claimed in claim 3, wherein the fibrous core has 200–5000 glass filaments.

6. A rubber reinforcing cord as claimed in claim 1, wherein the twisting rate of the fibrous core primary twist of is 40–150 turns/100 cm.

7. A rubber reinforcing cord as claimed in claim 1, wherein the twisting rate of the subsidiary strand primary twist is 40–150 turns/100 cm.

8. A rubber reinforcing cord as claimed in claim 1, wherein the twisting rate of the final twist of the fibrous core and the subsidiary is 40–150 turns/100 cm.

9. A rubber reinforcing cord as claimed in claim 1, wherein the fibrous core comprises a bundle of plural single fibers, each of which is twisted by a single fiber primary twist in the opposite direction from the subsidiary strand primary twist, or is not twisted primarily.

10. A rubber reinforcing cord as claimed in claim 1, wherein the cross sectional area of the fibrous core is from 5% to 95% relative to the cross sectional area of the entire cord.

11. A rubber reinforcing cord as claimed in claim 1, wherein the subsidiary strands are arranged about the fibrous core along a circle coaxially with the fibrous core at equal intervals.

12. A rubber reinforcing cord as claimed in claim 1, wherein an adhesive agent is applied to at least either the fibrous core or the subsidiary strands.

13. A rubber product employing a rubber reinforcing cord as claimed in claim 1.

14. A rubber reinforcing cord comprising:

a fibrous core; and a plurality of subsidiary strands disposed coaxially around the fibrous core, wherein each of the subsidiary strands has a subsidiary strand primary twist, the fibrous core and the subsidiary strands when twisted together have a final twist, the direction of the subsidiary strand primary twist and the direction of the final twist are the same, and the fibrous core has a fibrous core primary twist in a direction opposite to the direction of the subsidiary strand primary twist wherein the diameter of each subsidiary strand is smaller than the diameter of the fibrous core.

* * * * *